US005606896A

United States Patent [19]

Shammout

[11] Patent Number: 5,606,896

[45] Date of Patent: Mar. 4, 1997

[54] ARTICULATED GRIPPING BOX WRENCH FOR TIGHT SPACES

[76] Inventor: Mohammed Shammout, 3950 Ecochee Ave., San Diego, Calif. 92117

[21] Appl. No.: 383,916

[22] Filed: Feb. 6, 1995

[51] Int. Cl.[6] ..... B25B 13/10

[52] U.S. Cl. ..... 81/77; 81/128

[58] Field of Search ..... 81/77, 126, 128, 81/179

[56] References Cited

U.S. PATENT DOCUMENTS

| | | | |
|---|---|---|---|
| 2,486,523 | 11/1949 | Deschenes . | |
| 3,363,490 | 1/1968 | Maichen . | |
| 3,611,843 | 10/1971 | Engel | 81/128 |
| 3,858,465 | 1/1975 | Lind | 81/129 |
| 4,174,646 | 11/1979 | Kotler | 81/128 |
| 4,325,275 | 4/1982 | Colvin | 81/77 |

FOREIGN PATENT DOCUMENTS

| | | | |
|---|---|---|---|
| 69620 | 7/1949 | Denmark | 87/128 |
| 2316769 | 4/1973 | Germany | 87/128 |
| 386948 | 4/1965 | Switzerland | 87/10 A |
| 251544 | 5/1926 | United Kingdom . | |
| 384468 | 12/1932 | United Kingdom | 87/128 |

*Primary Examiner*—James G. Smith
*Attorney, Agent, or Firm*—Baker, Maxham, Jester & Meador

[57] ABSTRACT

A gripping box-wrench for engaging and torquing either undistorted or stripped nuts and bolts in tight spaces. A separate cam lever articulated from the wrench engages a rotatably-retained cam to apply a gripping force within a thin-wall polygonally-fluted box structure engaging a polygonal workpiece such as a hexagonal nut or bolt. Being applied by means of a separate cam lever, the gripping force may be varied independently of or proportionately with the torquing moment applied to the workpiece to increase the gripping force as necessary to retain engagement of a workpiece too distorted for torqueable engagement with the box structure. An undistorted nut or bolt may be engaged and torqued in the usual manner without requiring a gripping force. The box-end has a thin-walled geometry suitable for engaging workpieces in tight spaces.

9 Claims, 3 Drawing Sheets

ARTICULATED GRIPPING BOX WRENCH FOR TIGHT SPACES

BACKGROUND OF THE INVENTION

1. Field of the Invention

My invention relates generally to an adjustable box wrench and particularly to a box wrench that positively grips the workpiece in response to torque applied to a cam lever separately articulated from the wrench body.

2. Discussion of the Related Art

The box-end or box wrench is known in the art for turning polygonal nuts and bolts located in tight and inaccessible locations. The box wrench usually includes a thin-walled polygonally-fluted box structure on one or both ends. Because this thin-walled box structure is sized to fit snugly over the generally polygonal nut or bolt workpiece, the workpiece can be engaged for torquing even where there is only a few millimeters of clearance.

Adjustable wrenches, including adjustable box-end wrenches, are also known in the art. For instance, in U.S. Pat. No. 4,325,275, David S. Colvin discloses an adjustable open-end and box-end wrench that uses a pair of spaced pins and skewed slots to allow adjustment of a member that cooperates with a box-end to re-size the box structure for a range of workpiece dimensions. Although Colvin's box-end wrench can be used to engage a workpiece in tight spaces, he neither considers nor suggests "gripping" means for positively engaging a deformed workpiece and instead relies on the matching polygonal geometry of box structure and workpiece to transfer torque therebetween. Similarly, in U.S. Pat. No. 3,858,465, Erik Lind discloses an adjustable wrench employing an axially displaceable and lockable external sleeve to adjust the geometry of the box structure but neither considers nor suggests means for positively gripping a deformed workpiece. In U.S. Pat. No. 3,363,490, K. Maichen discloses a double-ended simultaneously-adjustable wrench that operates by manually turning an eccentric pin to move two members cooperating to form surfaces for receiving and torquing polygonal workpieces. Maichen also neither considers nor suggests means for positively gripping a deformed workpiece. Swiss Patent No. 386 948 issued to August Samuel Aegerter and U. K. Patent 251,544 issued to Andrew Arbuckle both disclose adjustable box-end wrenches that rely on the manual rotation of a cam to urge a sliding adjusting rod into a position that fixes the effective engagement dimensions of a box structure. Neither Aegerter nor Arbuckle consider or suggest means for positively gripping a deformed workpiece.

The common problem of transferring effective torque to deformed nuts and bolts is well-known in the art. When a nut is "frozen" onto a threaded bolt, the torque applied in attempting to remove it may deform the polygonal geometry of the outer nut surface to such an extent that a common box-end wrench (even an adjustable one) no longer properly engages the deformed surface to transfer torque. Rounded comers merely slip within the engaging box structure when torque is applied, accomplishing nothing.

Gripping pliers and wrenches are known in the art for torquing deformed workpieces. For instance, in U.S. Pat. No. 3,611,843, Joachim E. Engel discloses an adjustable socket wrench that has a gripping handle and a pair of relatively movable jaws, one of which is secured to the gripping handle and the other of which is cammed into engagement with its neighbor. Engel's handle includes a coarse adjusting member coupled to an axially movable jaw to permit adjustment of the socket dimensions by turning a threaded member. Engel's wrench increases the gripping force in the jaws responsive to an increase in the pivotal rotation of the jaws relative to the gripping handle arising from torque applied to the handle but cannot grip deformed workpieces in tight spaces. Similarly, in U.S. Pat. No. 4,174,646, Simon Cotler discloses a universal tool with gripping action and replaceable jaws that has a body with an opening adapted to interchangeably receive cassette-type work elements such as a box-end wrench element or the like. Cotler uses a cam-locking lever integrated into the universal tool to apply a predetermined gripping force on the workpiece. Disadvantageously, his universal tool employs a bulky structure to receive the cassette-type working element and is not suited for gripping polygonal workpieces in tight spaces. Moreover, contrary to Engel's advantageous feature of increasing gripping force proportionately with applied torque, Cotler's cam-locking scheme provides an unvarying gripping force that may be insufficient to retain the workpiece at high torque levels. Finally, in U.S. Pat. No. 2,486,523, P. E. Deschenes discloses a similar cam-locking adjustable gripping wrench for use with bottle caps.

Thus, although gripping wrenches are known in the art, including cam-operated and cam-locking gripping pliers and wrenches, no gripping wrench suitable for use in the tight spaces serviced by box-end wrenches has been known in the art until now. A wrench adapted to gripping and torquing polygonal workpieces in tight spaces could satisfy a clearly-felt need in the art. The related unresolved problems and deficiencies are clearly felt in the art and are solved by my invention in the manner described below.

SUMMARY OF THE INVENTION

My invention solves the above problem by adding to a thin-wall box wrench a separate cam lever to torque a cam to urge a gripping rod against the workpiece when torquing the workpiece. A moment applied to the separate cam lever operates in cooperation with the moment applied to the wrench body in transmitting torque to the polygonal workpiece. By engaging the workpiece by means of a thin polygonally-fluted box structure, the wrench of my invention can torque undeformed nuts and bolts in tight spaces in the usual manner without applying a gripping force, while also providing the capability for imposing a gripping force that can be increased proportionately with moment applied to the deformed workpiece.

In one aspect of my invention, the wrench has boxes at both ends, which may be sized for engaging and torquing bolts or nuts of different dimensions. By applying torque to a rotatably-retained cam in the wrench body, a rod is forced to grip a workpiece engaged at either end of the wrench. In a second aspect of my invention, the wrench body is shortened and includes a polygonally-fluted box structure at one end with the rotatably-retained cam disposed substantially at the other end, whereby the separate cam lever engages the rotatably-retained cam both to apply gripping force to the workpiece and to torque the workpiece.

It is an object of the wrench of my invention to provide for application of a gripping force to a workpiece in a tightly-accessible location. It is an advantage of the wrench of my invention that a workpiece may be tightly gripped if desired while engaged only by a thin polygonally-fluted box structure.

It is another object of the wrench of my invention to engage and torque undistorted workpieces in the usual manner without requiring a gripping force. It is a feature of the wrench of my invention that an undistorted polygonal workpiece may be engaged and torqued in the usual manner without applying a gripping force.

It is yet another object of the wrench of my invention to apply to a workpiece a gripping force that may be increased in proportion to the torque applied to the workpiece. It is an advantage of the wrench of my invention that the gripping force increases proportionately to the torque applied to a separate cam lever articulated from the wrench body. This lever torque is also applied to the workpiece in the desired direction, acting to increase workpiece torque in proportion with the gripping force. It is a feature of the wrench of my invention that the gripping force may be varied independently of the workpiece torque if desired.

The foregoing, together with other objects, features and advantages of this invention, can be better appreciated with reference to the following specification, claims and the accompanying drawing.

BRIEF DESCRIPTION OF THE DRAWING

For a more complete understanding of my invention, I now refer to the following detailed description of the embodiments as illustrated in the accompanying drawing, wherein.

DETAILED DESCRIPTION OF THE PREFERRED EMBODIMENTS

Figure 1:
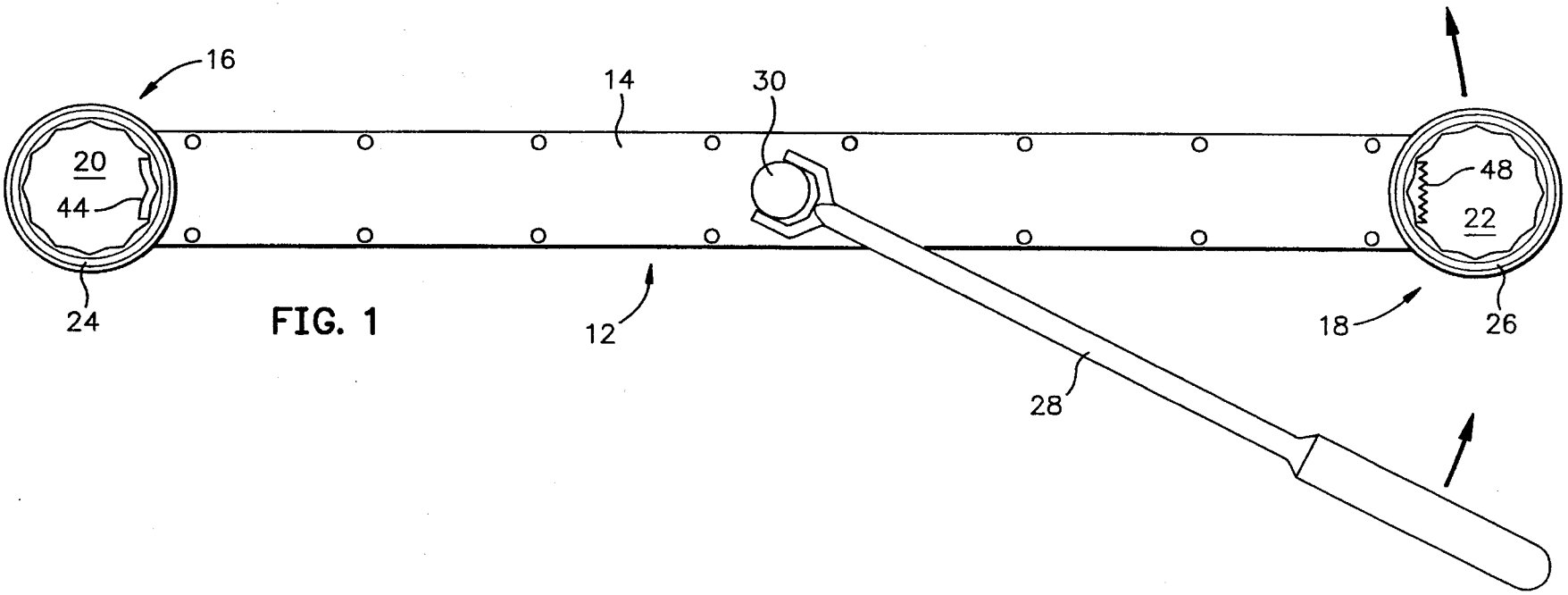
FIG. 1 is a front view of a double-ended gripping box wrench of my invention.

FIG. 1 shows my preferred embodiment of the two-ended box wrench 12 of my invention. Box wrench 12 includes an elongate hollow body 14 having the two ends 16 and 18. End 16 includes the polygonally-fluted box structure 20 and end 18 includes the polygonally-fluted box structure 22. Box structures 20 and 22 should be suitable for engaging and torquing polygonal workpieces such as hexagonal nuts and bolts of particular dimensions without gripping. Although box structures 20 and 22 are shown having a "fluted" internal profile, such profile may also be precisely machined to torqueably engage any particular workpiece geometry without straying from the basic idea of my invention. As used herein, "polygonally-fluted" denominates any and all such useful engagement profiles.

Box structure 20 includes a thin wall 24, which is an important element of my invention. Because wall 24 is no thicker than necessary to properly engage and torque a polygonal workpiece such as a hexagonal nut or bolt, my wrench can be employed to engage and grip workpieces in tight locations. Similarly, box structure 22 also includes the thin wall 26. Importantly, box structures 20 and 22 may be of different sizes suitable for engaging two different standard workpieces without gripping, in the usual manner. As discussed below, in operation, wrench 12 may apply a gripping force to a workpiece engaged at either end 16 or end 18 for either clockwise or counter-clockwise torquing. FIG. 1 also shows separate cam lever 28, which has a socket means 30 for engaging a rotatably-retained cam 32 (shown in FIG. 4) that is disposed within hollow body 14.

Figure 2:
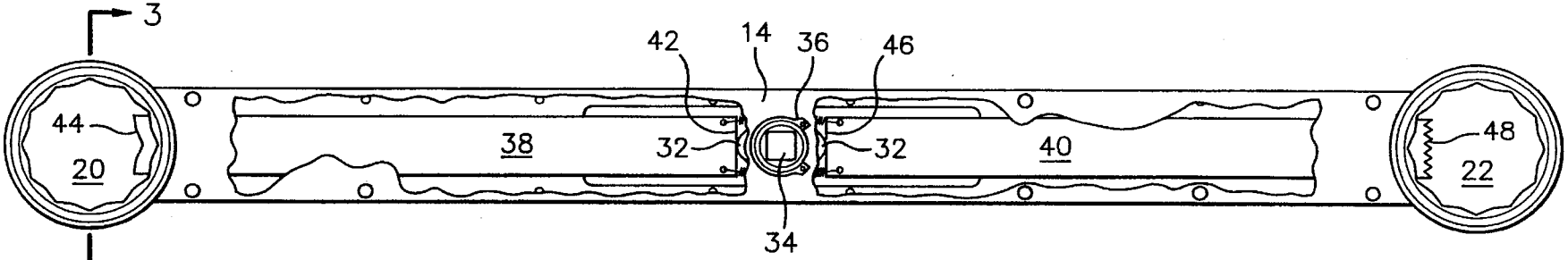
FIG. 2 is a view of the internal structure of the double-ended gripping box wrench of FIG. 1.

Referring to FIG. 2, the internal structure of my invention is now described. Rotatably-retained cam 32 (partially hidden) is shown having a socket means 34 for engaging socket means 30 in separate cam lever 28 (FIG. 1). Cam 32 is retained within hollow body 14 by means of a snap ring 36, which permits cam 32 to rotate freely. A gripping member 38 is disposed within hollow body 14 between cam 32 and box structure 20. Similarly, a second gripping member 40 is disposed within hollow body 14 between cam 32 and box structure 22. Gripping members 38 and 40 are freely disposed for movement within hollow body 14. Gripping member 38 has a smooth end 42 adjacent to cam 32 and a notched end 44 at box structure 20. Similarly, gripping lever 40 has a smooth end 46 adjacent to cam 32 and a notched end 48 at box structure 22.

Notched end 44 is shown as having a single flute suitable for engaging the corner of an undistorted polygonal workpiece. Notched end 48 is shown having a saw tooth notch pattern suitable for gripping a distorted or rounded workpiece surface. Practitioners skilled in the art can appreciate that either of the two exemplary notch patterns in notched ends 44 and 48 can be used to grip a variety of workpieces. Moreover, other notch patterns known in the art are useful when applied to this aspect of my invention. Accordingly, the two exemplary patterns shown for notched ends 44 and 48 are shown for illustrative purposes only and do not limit the idea of my invention. As used herein, "notched" denominates any and all such useful notch patterns.

Figure 3:
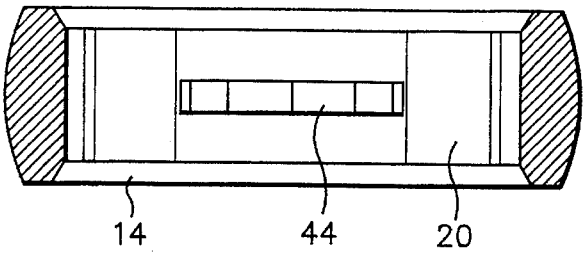
FIG. 3 is a cross-sectional view of the polygonally-fluted box structure from FIG. 2.

FIG. 3 shows the section 3—3 from FIG. 2. Notched end 44 of gripping member 38 is shown freely disposed within hollow body 14 and box structure 20 is shown in cross section.

Figure 6:
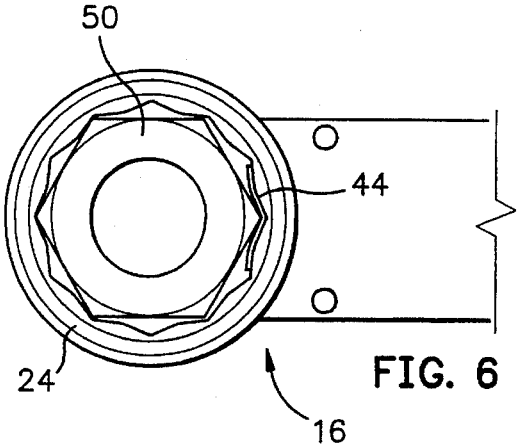
FIG. 6 shows the polygonally-fluted box structure engaging a polygonal workpiece while gripped with a gripping member having a first exemplary notched end.

FIG. 6 shows the engagement of a polygonal workpiece 50 with box wall 24 and notched end 44. Note that the single flute in notched end 44 engages a comer of workpiece 50, thereby preserving the surface of workpiece 50 without rounding or damage. Note also that no gripping force is necessary to torque workpiece 50 because all corners are torqueably engaged without assistance from gripping member 38.

Figure 7:
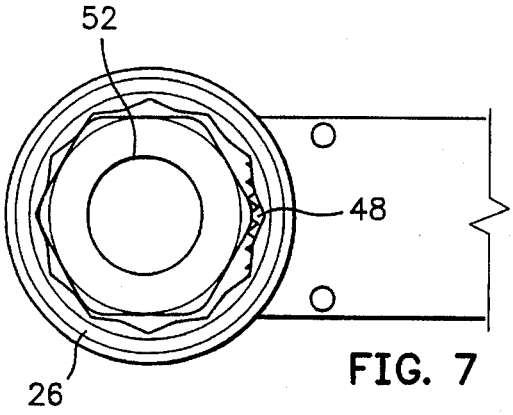
FIG 7 shows the box-engaged workpiece of FIG. 6 squeezed by a gripping member having a second exemplary notched end.

FIG. 7 shows a second workpiece 52 having a distorted surface with rounded corners engaged within box wall 26 and gripped by notched end 48 under applied gripping force. Note that the serrated geometry of notched end 48 effectively grips the rounded corner of workpiece 52, which would otherwise slip from engagement with the box wall 26 when torqued.

Figure 4:
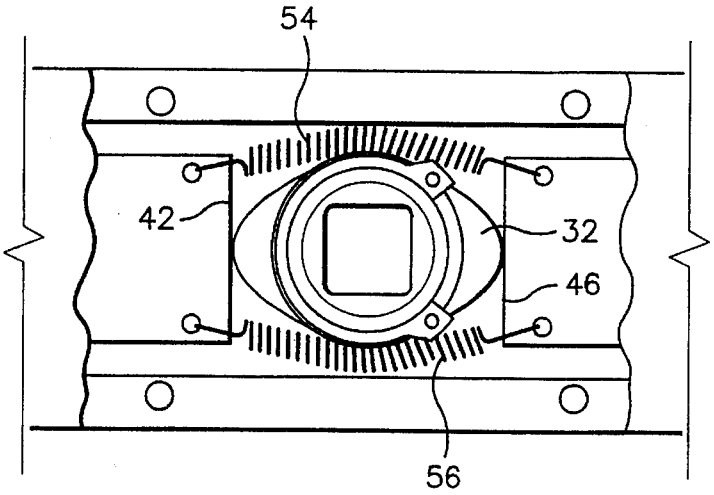
FIG. 4 is a detailed view of the rotatably-retained cam from the wrench of FIG. 1.
Figure 5:
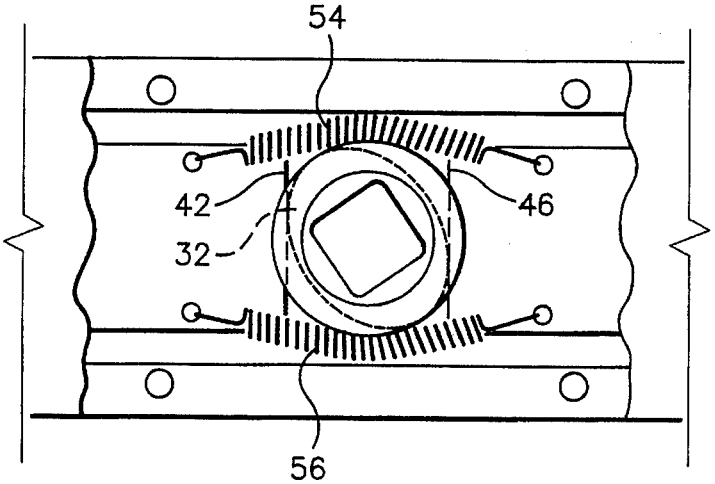
FIG. 5 is a second detailed view of the rotatably-retained cam from FIG. 4 in a retracted position.

FIGS. 4 and 5 show the details of the engagement of smooth ends 42 and 46 with rotatably-retained cam 32. In FIG. 4, cam 32 is shown in a first position having the cam lobes in contact with smooth ends 42 and 46, which are urged against cam 32 by a spring assembly consisting of springs 54 and 56, for example. I prefer the spring assembly shown because springs 54 and 56 couple only to gripping members 38 and 40 and are otherwise independent of hollow body 14 and rotatably-retained cam 32, thereby simplifying construction. In FIG. 5, cam 32 is shown in a second position where the main lobes are rotated away from smooth ends 42 and 46. Because of the urging action of springs 54 and 56, smooth ends 42 and 46 are retracted toward the center of cam 32. This retracts gripping members 38 and 40 from the two body ends 16 and 18 (FIGS. 1–2), thereby releasing any gripping force from workpieces 50 and 52 (FIGS. 6–7). Thus, in the wrench of my invention, rotation of cam 32 operates to simultaneously move the two gripping members 38 and 40 toward and away from workpieces engaged within box structures 20 and 22 (FIGS. 1–2). Because cam 32 is symmetric, this effect can be obtained by application of a cam moment in either direction.

Figure 10:
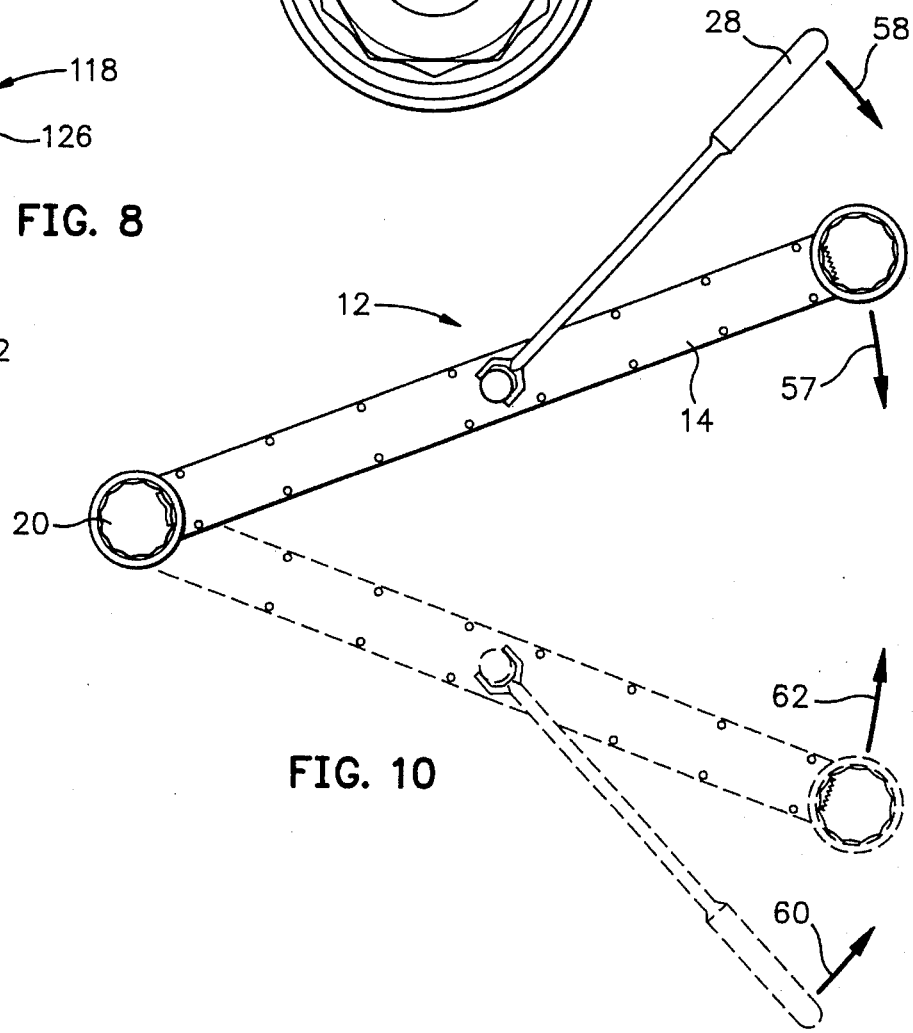
FIG. 10 shows the doubled-ended box wrench of my invention in operation with moments applied to the wrench body and a separate cam lever.

FIG. 10 illustrates the operation of the wrench of my invention. The solid figure shows wrench 12 engaging a workpiece (not shown) within box structure 20 for application of clockwise torque. A clockwise moment 57 is applied to hollow body 14 and a second clockwise moment 58 is applied to separate cam lever 28. Moment 58 transmitted through cam lever 28 to cam 32 acts to force gripping lever 38 outward into box structure 20 and against the workpiece (not shown). Increasing moment 58 operates to increase the gripping force against the workpiece engaged within box structure 20 and also operates to increase the torque applied to the workpiece, which is the sum of the two moments 57 and 58. If desired, the operator may increase the workpiece torque by increasing moment 57, without increasing moment 58 and thereby avoid undesired increases in gripping force when increasing workpiece torque.

The dotted portion of FIG. 10 shows the wrench of my invention engaging a workpiece (not shown) within box structure 20 for application of a counter-clockwise torque. Because cam 32 is symmetric, application of moment 60 to separate cam lever 28 also forces gripping member 38 into box structure 20, even though moment 60 is of opposite direction to moment 58. Thus, the workpiece engaged within box structure 20 is torqued by the sum of moments 60 and 62 while gripped with a force proportionate to moment 60.

Figure 8:
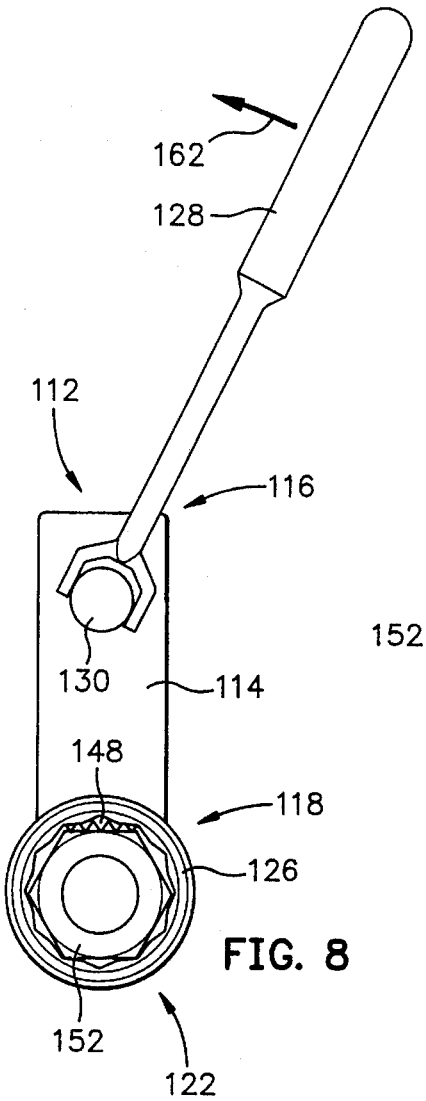
FIG. 8 shows a front view of a single-ended gripping box wrench of my invention.

FIG. 8 shows an alternative single-ended box wrench 112 of my invention. Wrench 112 includes an elongate hollow body 114 having two ends 116 and 118. Body end 118 includes a polygonally-fluted box structure 122, which has a thin box wall 126 shown engaging a polygonal workpiece 152. A separate cam lever 128 engages a rotatably-retained cam 132 located substantially at body end 116. Separate cam lever 128 includes a socket means 130 for engaging a second socket means 134 (FIG. 9) in cam 132.

Figure 9:
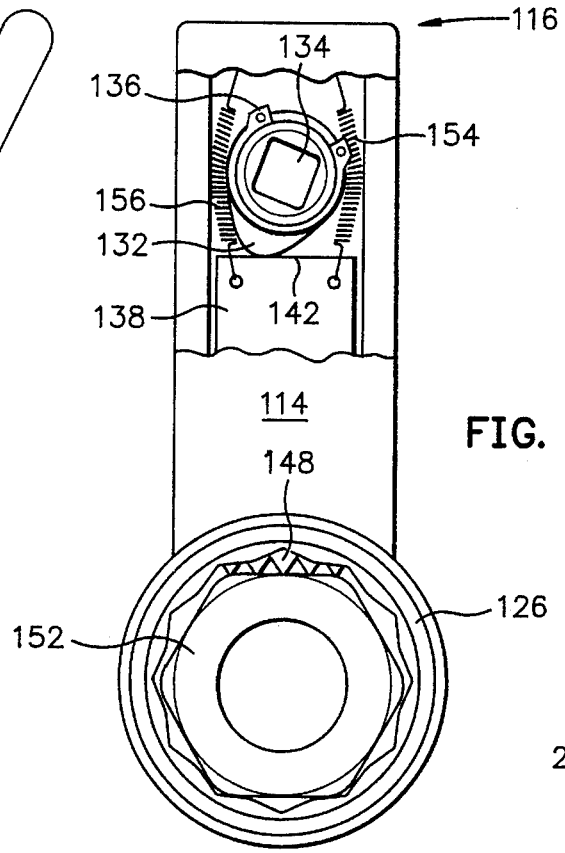
FIG. 9 shows an internal view of the single-ended box wrench of FIG. 8.

FIG. 9 shows the internal structure of wrench 112, which includes gripping member 138 having a smooth end 142 in contact with cam 132 and a notched end 148 in contact with workpiece 152. Smooth end 142 is urged into contact with cam 132 by operation of the springs 154 and 156, which couple gripping member 38 to hollow body end 116. Cam 132 is retained within hollow body 114 by a snap ring 136, which permits cam 132 to rotate freely.

In operation, a torque 162 applied to separate cam lever 128 operates both to force notched end 148 of gripping member 138 against workpiece 152 and to torque workpiece 152 in a counter-clockwise direction. The gripping force applied by notched end 148 to workpiece 152 is proportional to moment 162.

Clearly, other embodiments and modifications of my invention may occur readily to those of ordinary skill in the art in view of these teachings. Therefore, my invention is to be limited only by the following claims, which include all such embodiments and modifications when viewed in conjunction with the above specification and accompanying drawing.

I claim:

1. A gripping box wrench for engaging and torquing a polygonal workpiece without slippage, said gripping box wrench comprising:

an elongate hollow body having first and second ends, said first end including a first polygonally-fluted box structure for engaging a polygonal workpiece;

a rotatably-retained cam disposed within said elongate hollow body between said first and second elongate hollow body ends and having means for engaging a separate cam lever;

a separate cam lever having an end with means for engaging said rotatably-retained cam to apply torque thereto, whereby said cam rotates responsive to torque applied by said separate cam lever;

a first gripping member having a smooth end and a notched end movably disposed within said elongate hollow body with said smooth gripping member end disposed adjacent said rotatably-retained cam and said notched gripping member end disposed to slide in and out of said first polygonally-fluted box structure at said first elongate hollow body end responsive to rotation of said rotatably-retained cam;

a spring assembly disposed within said elongate hollow body coupled to said first gripping member to urge said smooth gripping member end against said rotatably-retained cam during cam rotation;

a second polygonally-fluted box structure at said second elongate hollow body end; and a second gripping member having a smooth end and a notched end movably disposed within said elongate hollow body with said smooth gripping member end disposed adjacent said rotatably-retained cam and said notched gripping member end disposed to slide in and out of said second polygonally-fluted box structure at said second elongate hollow body end responsive to rotation of said rotatably-retained cam; wherein said spring assembly is coupled to said first and second gripping members to urge both said smooth gripping member ends against opposite sides of said rotatably-retained cam during cam rotation.

2. The gripping box wrench of claim 1 wherein said first polygonally-fluted box structure at said first elongate hollow body end is sized to engage a first polygonal workpiece and said second polygonally-fluted box structure at said second elongate hollow body end is sized to engage a second polygonal workpiece of dimensions different from those of said first polygonal workpiece.

3. The gripping box wrench of claim 2 wherein said spring assembly is coupled between said first and second gripping members independently of said elongate hollow body end.

4. The gripping box wrench of claim 3 wherein said separate cam lever end engages said rotatably-retained cam by means of a polygonal socket for transferring torque therebetween.

5. The gripping box wrench of claim 1 wherein said spring assembly is coupled between said first and second gripping members independently of said elongate hollow body end.

6. The gripping box wrench of claim 1 wherein said separate cam lever end engages said rotatably-retained cam by means of a polygonal socket for transferring torque therebetween.

7. The gripping box wrench of claim 6 wherein said first polygonally-fluted box structure at said first elongate hollow body end is sized to engage a first polygonal workpiece and said second polygonally-fluted box structure at said second elongate hollow body end is sized to engage a second polygonal workpiece of dimensions different from those of said first polygonal workpiece.

8. The gripping box wrench of claim 1 wherein said first elongate hollow body end includes said first polygonally-fluted box structure and said rotatably-retained cam is disposed substantially at the second said elongate hollow body end.

9. The gripping box wrench of claim 1 wherein said separate cam lever end engages said rotatably-retained cam by means of a polygonal socket for transferring torque therebetween.

* * * * *